US009925650B2

(12) United States Patent
Markiewicz

(10) Patent No.: US 9,925,650 B2
(45) Date of Patent: Mar. 27, 2018

(54) TORQUE LIMITING FILTER WRENCH

(71) Applicant: Bartosz Markiewicz, Burlington (CA)

(72) Inventor: Bartosz Markiewicz, Burlington (CA)

( * ) Notice: Subject to any disclaimer, the term of this patent is extended or adjusted under 35 U.S.C. 154(b) by 175 days.

(21) Appl. No.: 14/956,059

(22) Filed: Dec. 1, 2015

(65) Prior Publication Data

US 2016/0151895 A1 Jun. 2, 2016

(30) Foreign Application Priority Data

Dec. 1, 2014 (CA) ..... 2872837

(51) Int. Cl.

| | |
|---|---|
| ***B25B 23/14*** | (2006.01) |
| ***B25B 27/00*** | (2006.01) |
| ***B25B 13/50*** | (2006.01) |
| ***B25B 13/48*** | (2006.01) |

(52) U.S. Cl.
CPC ..... *B25B 23/141* (2013.01); *B25B 27/0042* (2013.01)

(58) Field of Classification Search
CPC ..... B25B 23/141; B25B 27/0042
USPC ..... 81/474
See application file for complete search history.

(56) References Cited

U.S. PATENT DOCUMENTS

| | | | | |
|---|---|---|---|---|
| 1,566,553 | A | 12/1925 | Maisch | |
| 1,860,871 | A | 5/1932 | Pouliot | |
| 2,332,971 | A | 10/1943 | Johnson | |
| 2,797,564 | A * | 7/1957 | Bonneau | B25B 23/1427 464/38 |
| 2,802,354 | A | 8/1957 | Bohnhoff | |
| 2,948,173 | A * | 8/1960 | Herrmann | B25B 23/141 464/36 |
| 3,167,936 | A | 2/1965 | Engquist | |
| 3,168,944 | A | 2/1965 | Livermont | |
| 3,277,670 | A | 10/1966 | Bent | |
| 3,277,671 | A | 10/1966 | Winstone et al. | |
| 3,305,058 | A | 2/1967 | Orwin et al. | |
| 3,542,162 | A | 11/1970 | Kerr et al. | |
| 3,613,751 | A | 10/1971 | Juhasz | |
| 3,653,226 | A | 4/1972 | Westbury | |
| 3,662,628 | A * | 5/1972 | Schnepel | B25B 23/141 464/36 |
| 3,702,546 | A | 11/1972 | Schnepel | |
| 3,942,337 | A * | 3/1976 | Leonard | B25B 23/141 464/36 |
| 4,041,729 | A | 8/1977 | Bilz | |
| 4,668,206 | A | 5/1987 | Fukumoto | |
| 4,712,456 | A | 12/1987 | Yuan | |
| 5,035,311 | A | 7/1991 | Girguis | |
| 5,054,588 | A | 10/1991 | Thorp et al. | |

(Continued)

FOREIGN PATENT DOCUMENTS

DE 202008007294.8 10/2009

*Primary Examiner* — Hadi Shakeri
(74) *Attorney, Agent, or Firm* — Bereskin & Parr LLP/S.E.N.C.R.L., s.r.l.

(57) ABSTRACT

An oil filter socket having a torque limited maximum is provided. Namely, a torque limiting mechanism is provided interior a bore defined by a nut adapted to receive a conventional ratchet. The torque limiting mechanism includes a cam having bearing race notches formed circumferentially there-around. A plurality of ball bearings rest inside the notches until the rotational torque force applied to the socket from the ratchet overcomes the spring force acting opposite the cam.

16 Claims, 18 Drawing Sheets

(56) References Cited

U.S. PATENT DOCUMENTS

| | | | | |
|---|---|---|---|---|
| 5,156,244 | A | 10/1992 | Pyles et al. | |
| 5,356,350 | A | 10/1994 | Schreiber | |
| 5,383,818 | A | 1/1995 | Lessat-Kaupat et al. | |
| 5,505,676 | A | 4/1996 | Bookshar | |
| 5,560,269 | A * | 10/1996 | Zelenka | B25B 27/0042 81/125 |
| 6,132,435 | A | 10/2000 | Young | |
| 6,312,339 | B1 | 11/2001 | Beyert | |
| 6,640,674 | B1 | 11/2003 | Rinner et al. | |
| 7,467,576 | B2 | 12/2008 | Gao | |
| 8,161,849 | B2 * | 4/2012 | Stark | B25B 23/141 81/473 |
| 2011/0094354 | A1 * | 4/2011 | Lai | B25B 13/06 81/475 |
| 2013/0134085 | A1 * | 5/2013 | Huff | B01D 29/96 210/232 |

* cited by examiner

TORQUE LIMITING FILTER WRENCH

CROSS REFERENCE TO RELATED APPLICATION

The present application claims priority from and the benefit of Canadian Patent Application No. 2,872,837 filed on Dec. 1, 2014, the entire contents of which is hereby incorporated herein by reference.

BACKGROUND

Technical Field

The present disclosure relates generally to the field of hand tools. More particularly, the present disclosure relates to a socket wrench or ratchet that includes an oil filter socket for removing an oil filter from an engine. Specifically, the present disclosure relates to a socket for a ratchet dimensioned to remove an oil filter canister from an engine, the socket having a torque limiting mechanism therein.

Background Information

A socket wrench is a type of wrench that has a socket attached at one end. Often the socket wrench operates in a ratcheting motion and may be referred to as a ratchet. A ratchet is a hand tool in which a metal handle is attached to a ratcheting mechanism, which attaches to a socket, which in turn fits onto a type of bolt or nut.

The ratchet is pulled or pushed in one direction by an operation. During movement, the ratchet loosens or tightens the bolt or nut attached to the socket. Turned the other direction, the ratchet does not turn the socket but allows the ratchet handle to be re-positioned for another turn while staying attached to the bolt or nut. This ratcheting action allows the fastener to be rapidly tightened or loosened in small increments without disconnecting the tool from the fastener.

Some ratchets may have a switch is built into the ratchet head that allows the user to apply the ratcheting action in either direction, as needed, to tighten or loosen a fastener.

Oil filters are generally screwed on to an engine. During the installation process a sufficient amount of torque is required for the oil filter to seal properly while an excessive amount of torque will make the oil filter difficult to remove or cause damage to the interfacing surfaces. Mechanics generally utilize a torque wrench in conjunction with an oil filter wrench/oil filter socket which requires multiple tools to perform the task and the latter results in a possible under or over torque condition.

SUMMARY

Issues continue to exists with the current types of oil filter wrenches and oil filter sockets utilized in conjunction with a torque wrench and heretofore, upon information and belief, an oil filter socket having a torque limiting mechanism therein has never been developed. The present disclosure addresses these and other issues.

In one aspect, the disclosure may provide an oil filter socket comprising: a first end spaced opposite a second end and a central axis extending therebetween; a cup including an edge defining an opening adjacent the first end and an inner surface extending axially towards a closed end, the inner surface defining a filter cavity sized to receive an oil filter therein; a nut adjacent the closed end exterior the cup and centered about the central axis, the nut defining a bore; and a torque limiting mechanism interior the bore centered about the central axis configured to selectively set a tightening torque maximum of the oil filter socket.

In another aspect, the disclosure may provide a torque limiting mechanism on an oil filter socket comprising: a plurality of ball bearings disposed within an axially aligned bore formed by a nut; a spring in the operatively connected to the plurality of ball bearings inside the bore; a set screw adjacent an end of the nut; a cam intermediate the plurality of ball bearings and the spring, the cam defining a plurality of circumferentially extending notches, wherein each notch is formed from two walls aligned at different incident angles relative to a central axis; and a socket rigidly connected to the nut sized to receive an oil filter bolt.

In another aspect, the disclosure may provide a method comprising the steps of: setting a torque maximum limit inside an oil filter socket; connecting the oil filter socket to one of (i) an oil filter canister, and (ii) an oil filter bolt head; and rotating the oil filter socket with a ratchet free of any torque limiting settings until the torque maximum limit inside the oil filter socket has been reached.

In another aspect, the disclosure may provide an oil filter socket having a torque limited maximum. Namely, a torque limiting mechanism is provided interior a bore defined by a nut adapted to receive a conventional ratchet. The torque limiting mechanism includes a cam having bearing race notches formed circumferentially there-around. A plurality of ball bearings rest inside the notches until the rotational torque force applied to the socket from the ratchet overcomes the spring force acting opposite the cam.

BRIEF DESCRIPTION OF THE SEVERAL VIEWS OF THE DRAWINGS

A sample embodiment of the disclosure is set forth in the following description, is shown in the drawings and is particularly and distinctly pointed out and set forth in the appended claims. The accompanying drawings, which are fully incorporated herein and constitute a part of the specification, illustrate various examples, methods, and other example embodiments of various aspects of the disclosure. It will be appreciated that the illustrated element boundaries (e.g., boxes, groups of boxes, or other shapes) in the figures represent one example of the boundaries. One of ordinary skill in the art will appreciate that in some examples one element may be designed as multiple elements or that multiple elements may be designed as one element. In some examples, an element shown as an internal component of another element may be implemented as an external component and vice versa. Furthermore, elements may not be drawn to scale.

Similar numbers refer to similar parts throughout the drawings.

DETAILED DESCRIPTION

Figure 1:
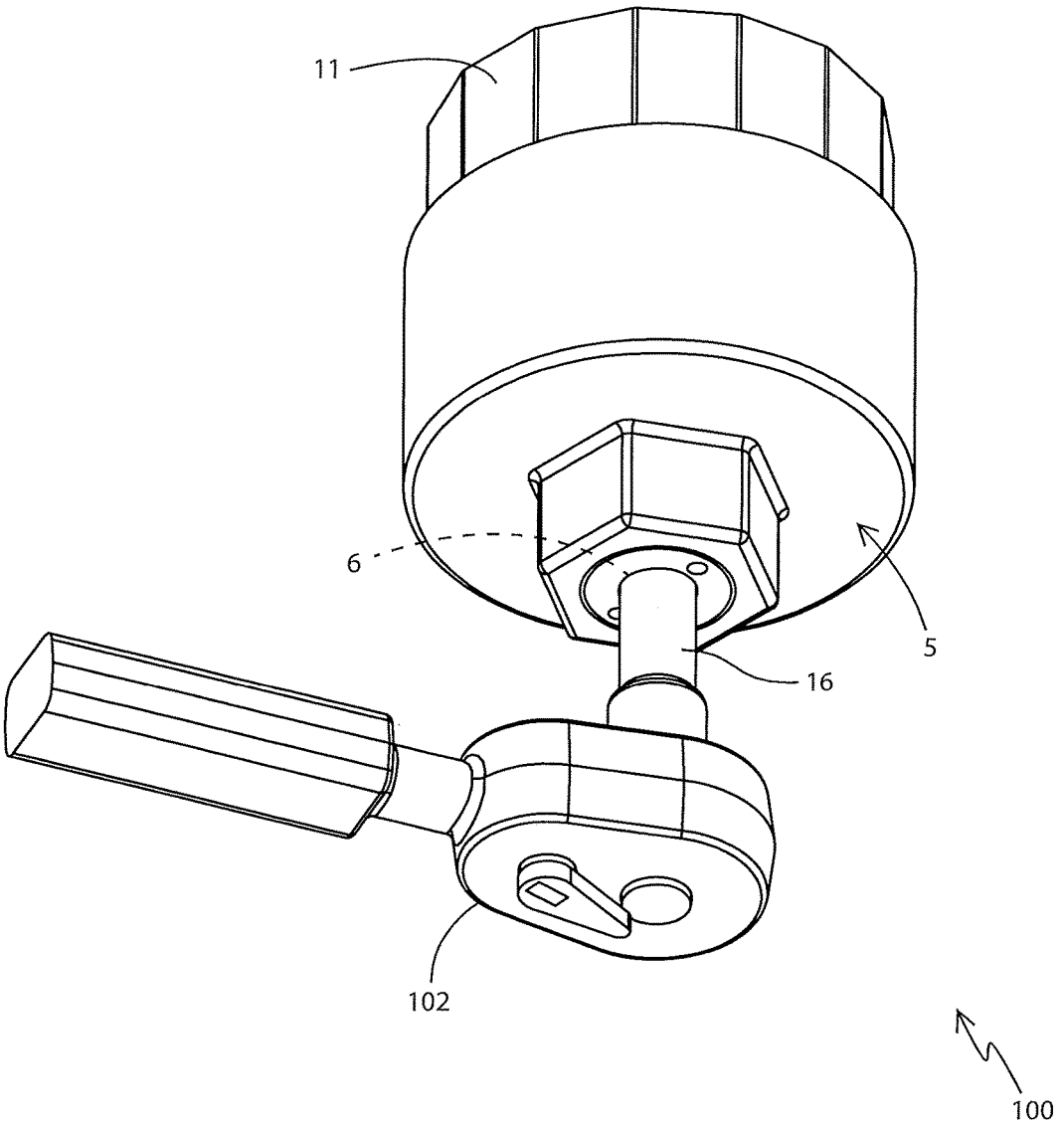
FIG. 1 is a perspective view of an example of a torque limiting filter wrench system.

As depicted in FIG. 1, a torque limiting filter wrench system 100 includes a socket wrench or ratchet 102, a drive extension 16, and an oil filter socket 5 having a torque limiting clutch mechanism 6 therein.

Figure 2:
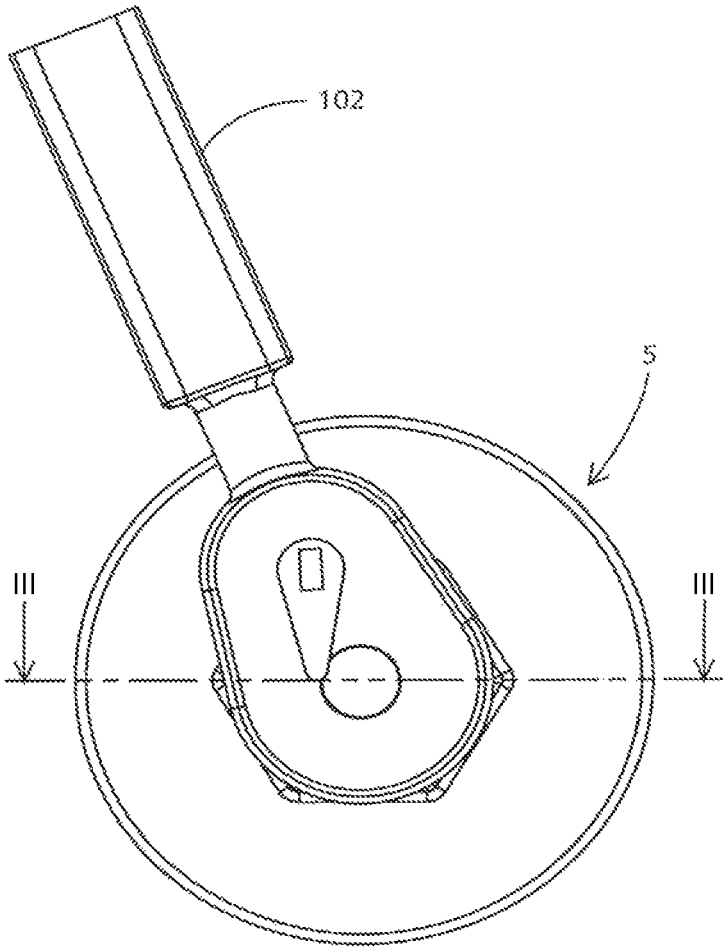
FIG. 2 a bottom view of the system of FIG. 1.
Figure 3:
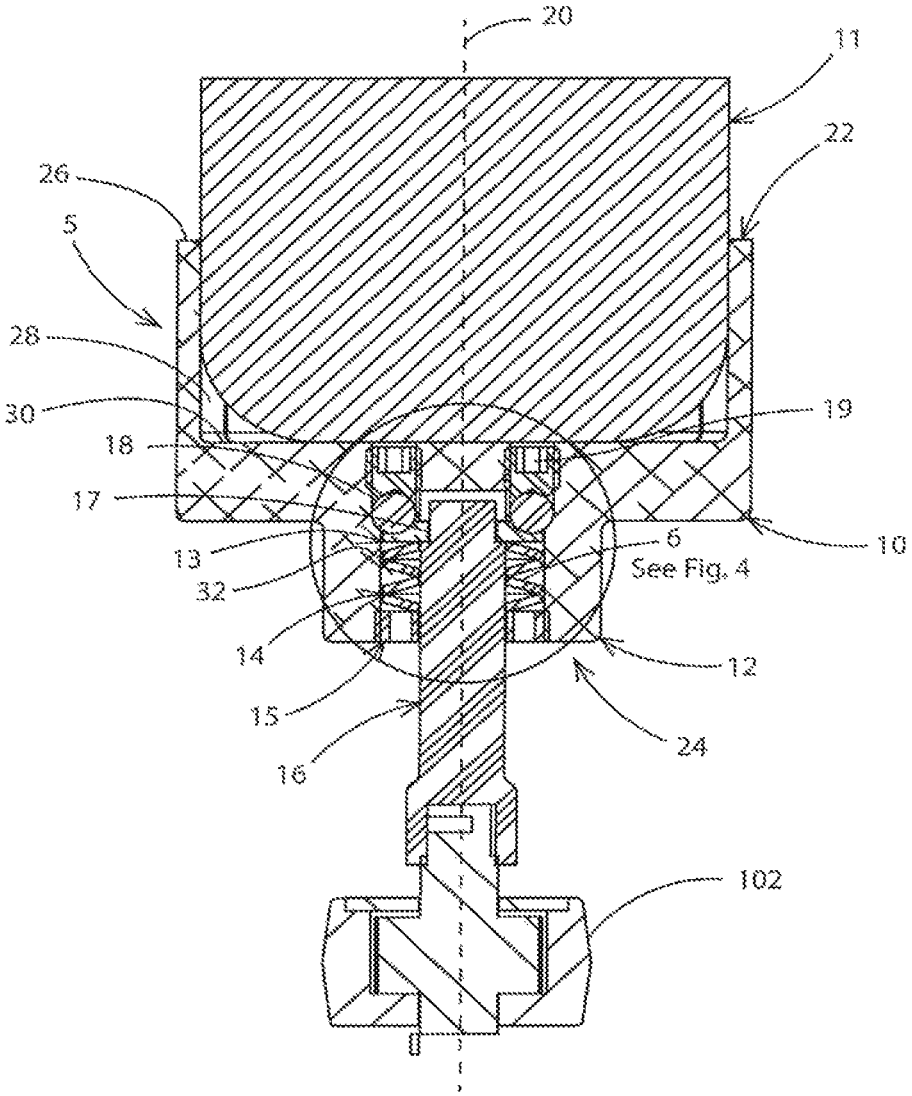
FIG. 3 is a cross section view taken along line III-III in FIG. 2.
Figure 4:
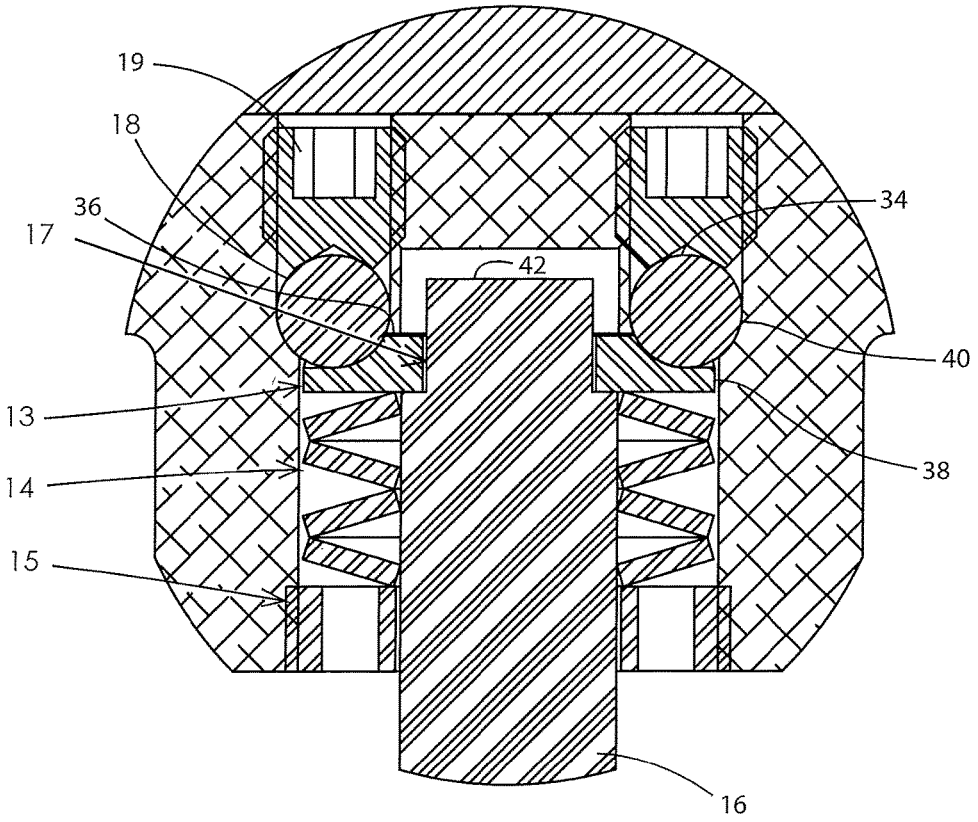
FIG. 4 is an enlarged view of a portion of FIG. 3.

As depicted in FIG. 2 through FIG. 4, oil filter socket 5 includes a first end 22 opposite a second end 24 centered about a central axis 20 extending therebetween. Oil filter socket 5 includes a cup 10, a nut 12, a cam 13, a spring 14, a threaded disc 15, a square hole 17 defined by cam 13, a plurality of following ball bearings 18, and set screws 19.

Cup 10 include an annular edge 26 at first end 22 defining an opening to an oil filter chamber 28 defined by an inner surface of cup 10. Cup 10 further includes a closed end 30 offset from first end 22 having apertures therein threadedly receiving set screws 19.

Nut 12 is rigidly connected to cup 10 and is offset towards the second end 24 from cup 10 adjacent closed end 30 and centered about central axis 20. Nut 12 defines a bore 32 where some components of torque limiting clutch mechanism 6 are retained.

Within bore 32, annular spring member 14 is centered axially along central axis 20 interior the inner surface of nut 12 intermediate the threaded adjustment member 15 and cam 13.

A plurality of ball bearings 18 are positioned around central axis 20 in an equally spaced manner intermediate cam 13 and set screws 19. Ball bearings 18 have an upper portion 34 that is closer to first end 22 than a cam end 36 that faces the same direction as upper portion 34. Cam 13 further includes circumferential outer edge 38 that is radially closer to central axis 20 than a tangential outer edge 40 of ball bearing 18. Cam 13 defines square hole 17 which is configured to releasably mate with a foremost end 42 of extension 16 releasably coupled to ratchet 102.

With continued reference to FIG. 2 through FIG. 4, the set screws 19 are equal to the number of ball bearings 18 retained within bore 32 of nut 12. In the shown example, there are two ball bearings 18 and two associated set screws 19 respectively coupled therewith. In the embodiment depicted in FIG. 2 through FIG. 4, set screws 19 are threadedly adjustable through apertures formed in cup 10 adjacent closed end 30 inside oil filter chamber 28 as is depicted in the bottom plan views of FIG. 6 and FIG. 7. Note that the bottom plan views of FIG. 6 and FIG. 7 depict two set screws but there could be any number of plurality of set screws, each associated with the ball bearings 18 and as stated above, and in one particular embodiment includes three set screws respectively coupled with three ball bearings.

Figure 5:
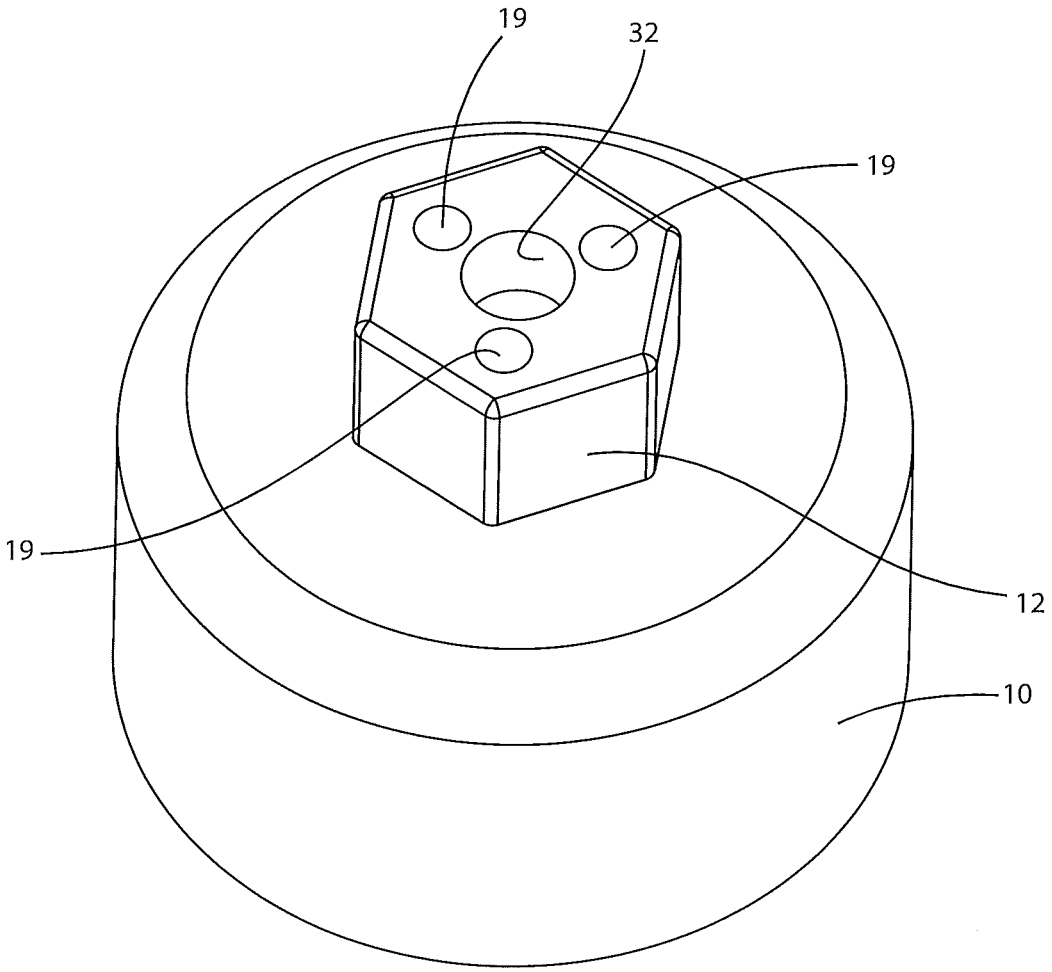
FIG. 5 is a perspective view of an oil filter socket having a torque limiting mechanism therein.

Alternatively, another embodiment may reverse the torque limiting clutch mechanism 6 within a bore 32 of nut 12 as is depicted in FIG. 5 wherein the set screws 19 are adjustable by extending through nut 12 which requires threaded disc 15 to extend towards first end 22 adjacent closed end 30 of cup 10.

Figure 6:
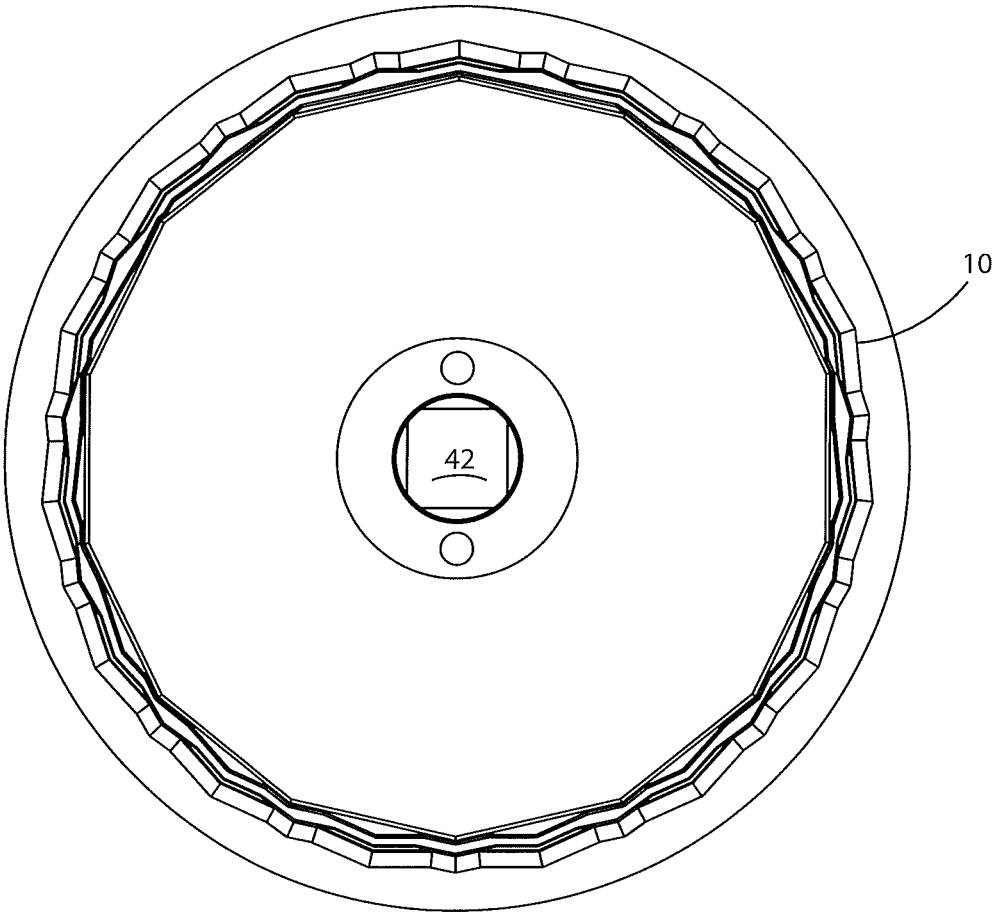
FIG. 6 is a bottom view of the oil filter socket with a cup having a first inner shape.
Figure 7:
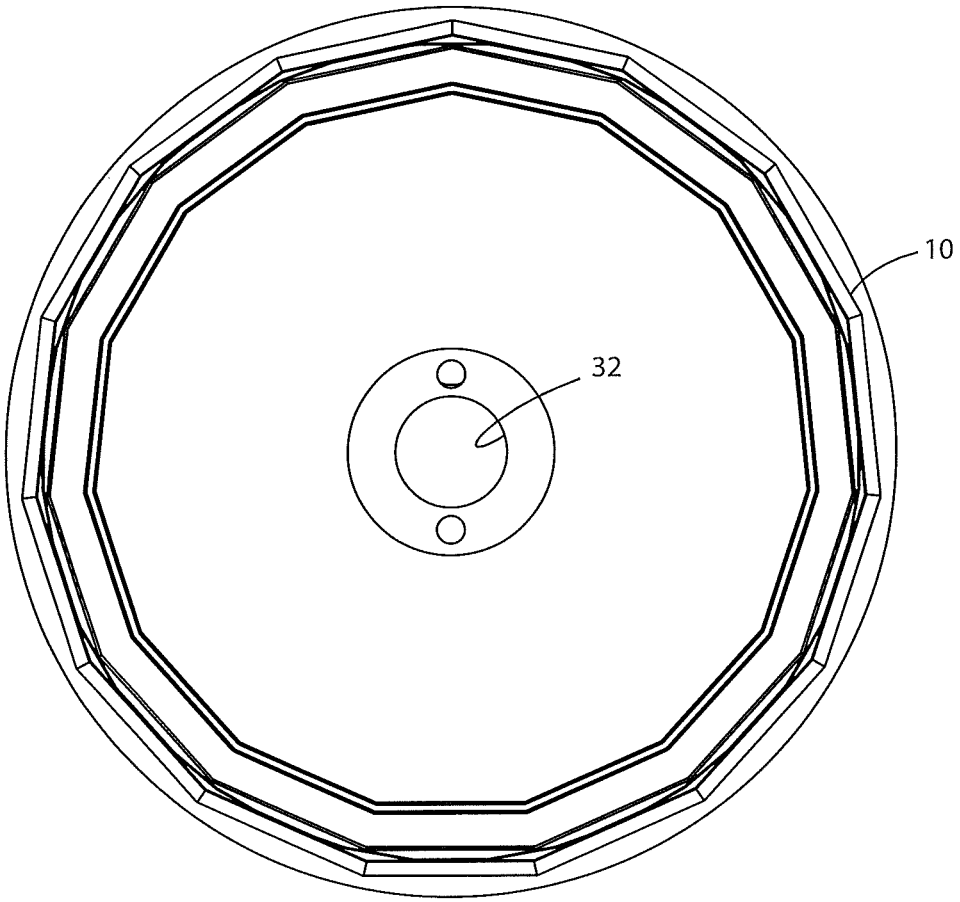
FIG. 7 is a bottom view of the oil filter socket with a cup having a second inner shape.
Figure 8:
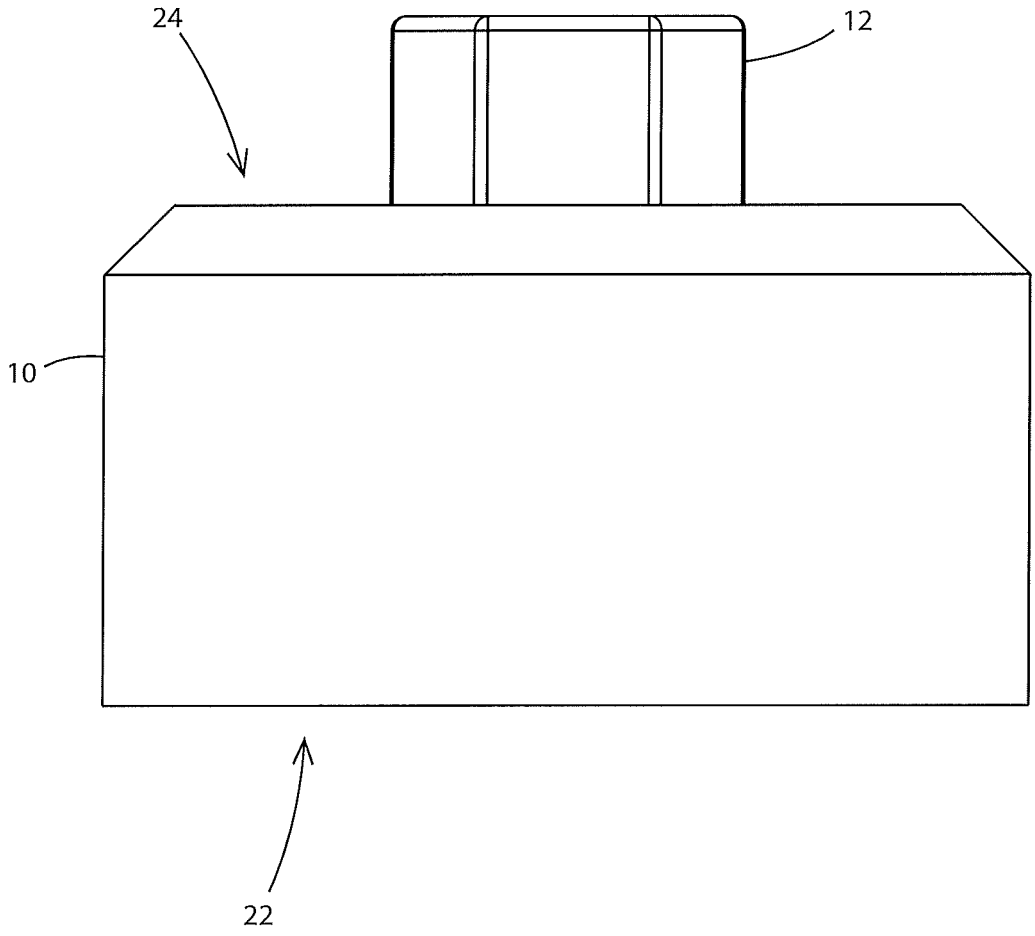
FIG. 8 is a side view of the oil filter socket.

As depicted in FIG. 6 and FIG. 7, the bottom plan views of alternate embodiments of cup 10 are provided to show that the interior chamber 28 may be formed of different geometric configurations depending on the type of oil filter 11 that needs to be tightened or loosened through the use of system 100.

As depicted in FIG. 9 through FIG. 18, an additional exemplary embodiment of the present disclosure may include portions of the torque limiting clutch mechanism 6 interior to a socket 50 formed with nut 12 directly connected in a rigid manner to an cylindrical housing 52 forming a ledge 54 at the rigid connection between the two. With this version, cup 10 is not shown but may be attached and extend away from ledge 54 in a manner as one having ordinary skill in the art would understand in order to grasp an oil filter therein.

Figure 12:
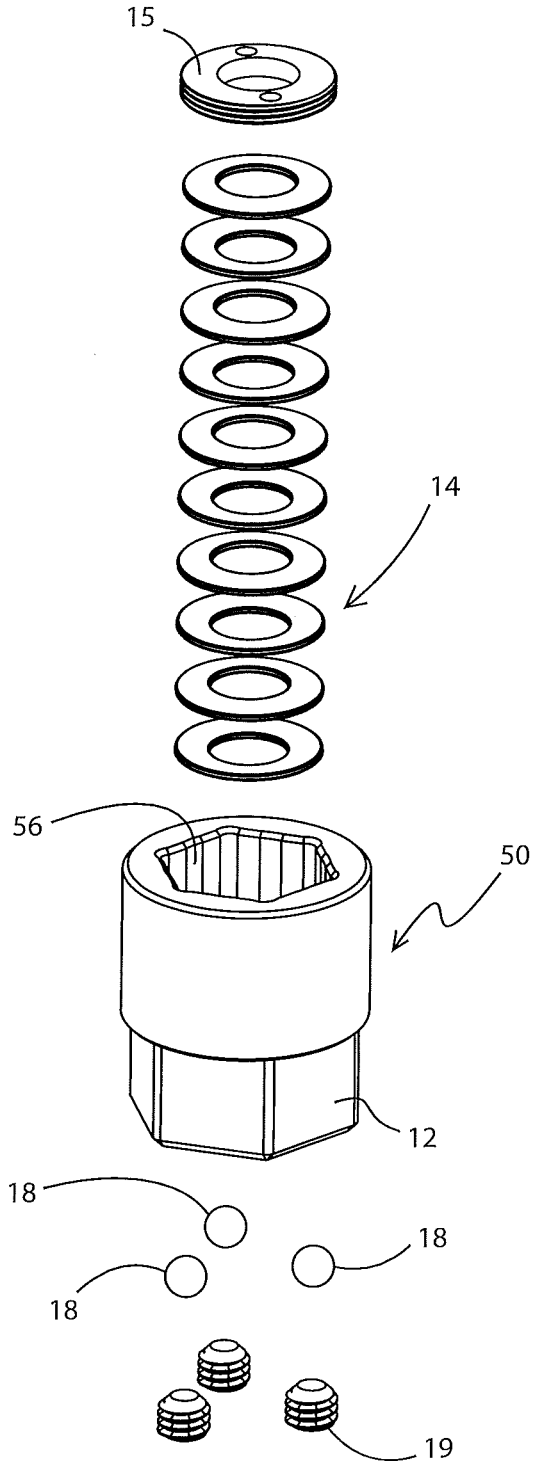
FIG. 12 is an exploded view of the device of FIG. 9.

As depicted in FIG. 12, the three set screws 19 are each associated with the plurality of ball bearings 18 inside a bore 56 of socket 50. In this embodiment, spring 14 is a sprig formed from belleville washers applying force against a cam 60.

Figure 13:
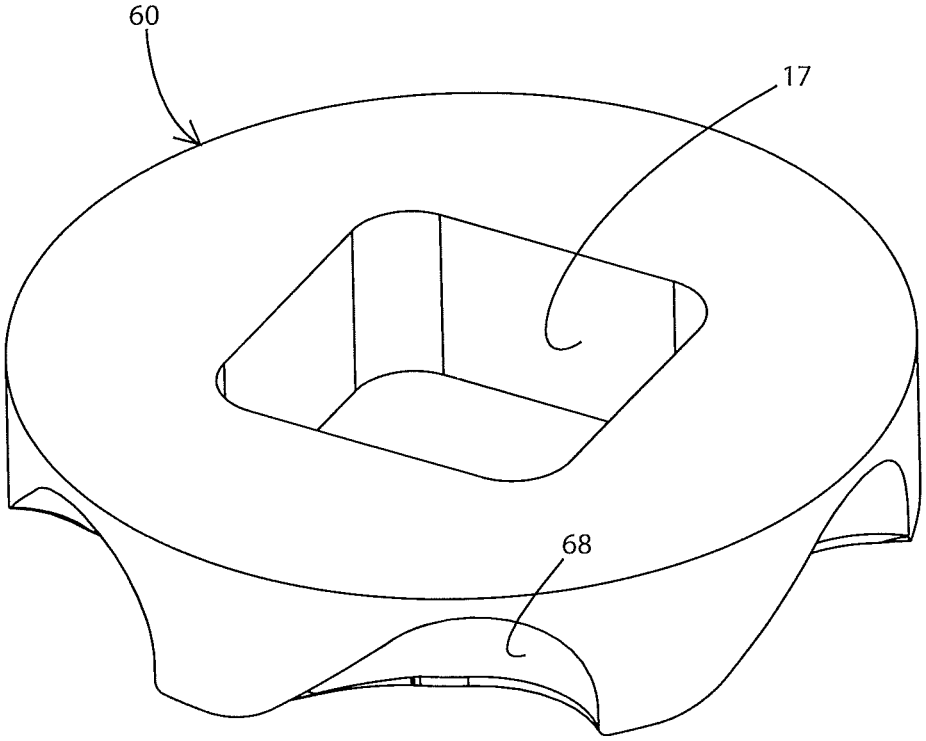
FIG. 13 is a bottom perspective view of a cam portion of the device of FIG. 9.
Figure 14:
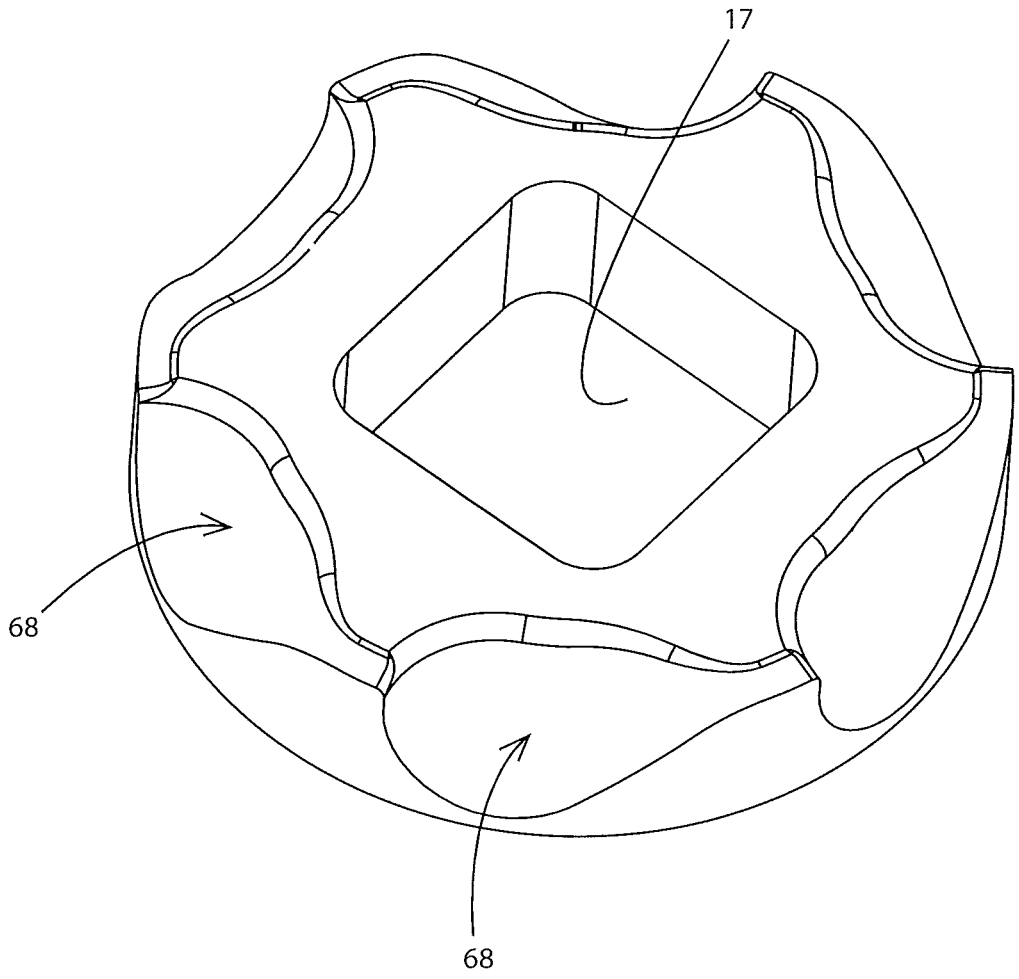
FIG. 14 is a top perspective view of the cam portion of FIG. 13.
Figure 15:
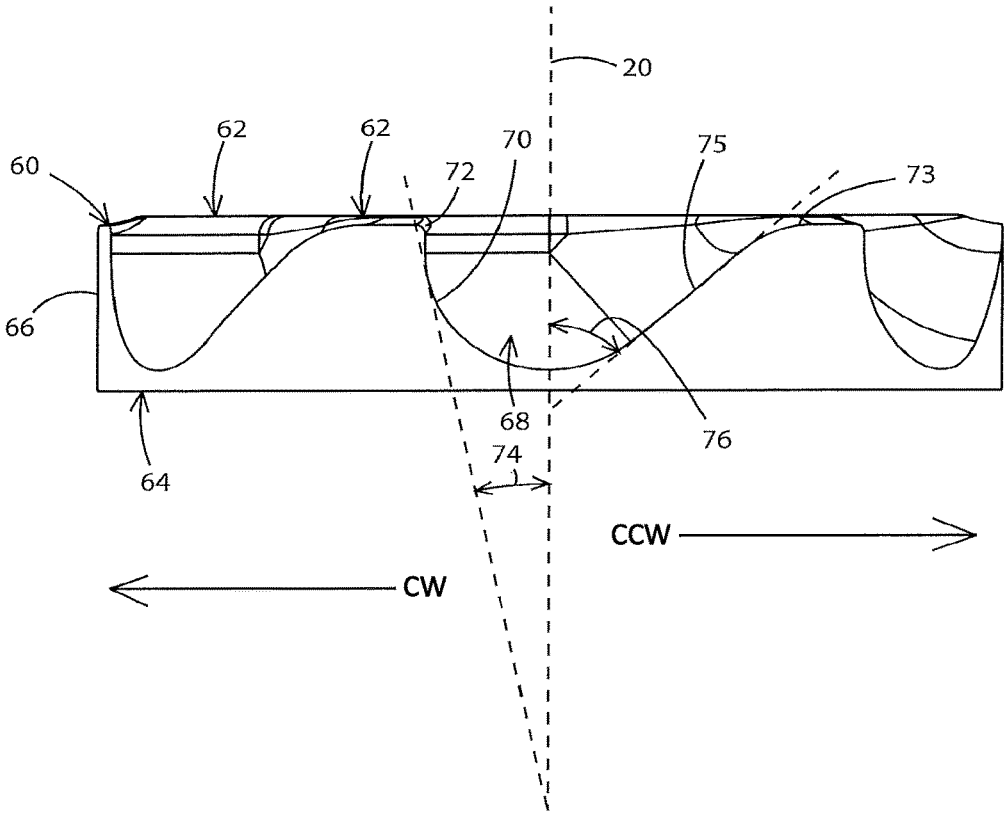
FIG. 15 is a side view of the cam portion of FIG. 13.
Figure 16:
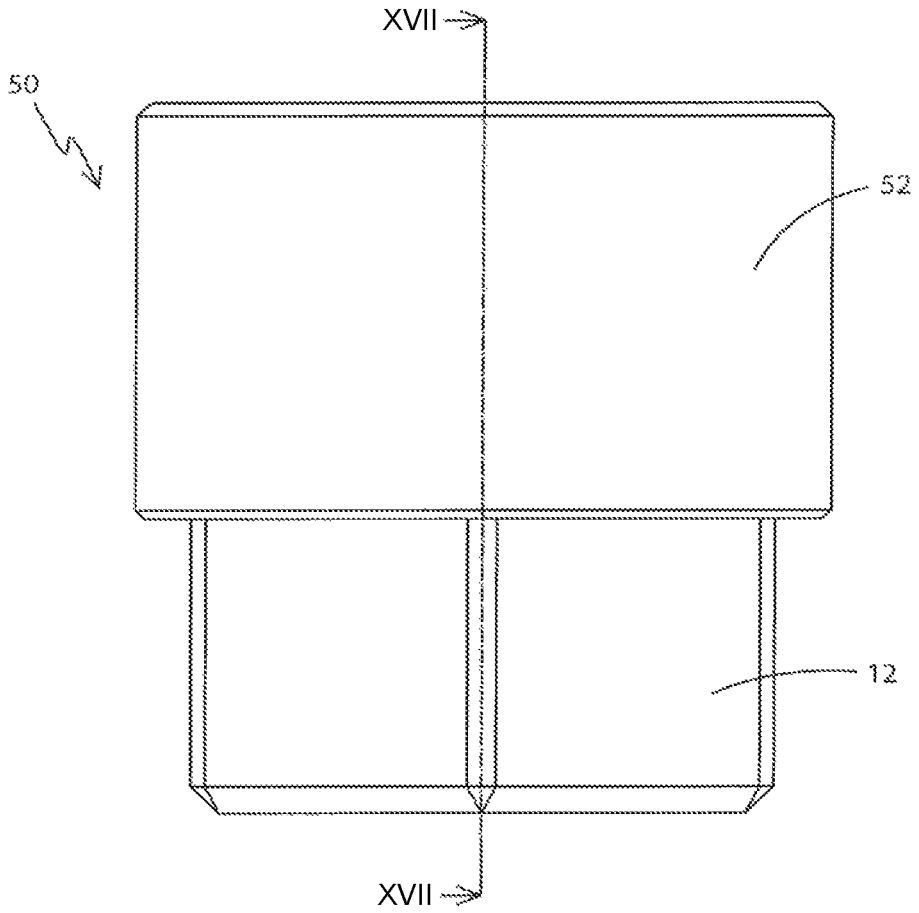
FIG. 16 is another side view of the device of FIG. 9.

As depicted in FIG. 13 through FIG. 15, a cam 60 includes a first end 62 opposite a second end 64 and a cylindrical sidewall 66 extending therebetween. Cam 60 forms a plurality of circumferentially extending notches 68 configured to receive ball bearings 18 therein in an assembled state. Each notch 68 is formed of two side walls. Namely, a first sidewall 70 which slopes up to a top 72 at first end 62 at a first incident angle 74. A second sidewall 75 extends upwardly towards an upper terminal end 73 at a second incident angle 76. Second incident angle 76 is different than the first incident angle 74. First incident angle 74 is smaller than second incident angle 76. First incident angle 74 is associated with counterclockwise rotation of socket 50 and the second incident angle is associated with clockwise rotation of socket 50. The clockwise rotation is identified as arrow CW in FIG. 15 and the counterclockwise rotation is identified by arrow CCW in FIG. 15. The first incident angle 74 associated with a counterclockwise rotation is smaller relative to central axis 20 which increases the torque setting for loosening rotation of attaching oil filter 11 to an engine block. The purpose of the narrower first incident angle 74 is to allow for a greater torque to be applied during the loosening process as the ratchet and the device is turned in the counterclockwise direction. In one particular embodiment, the torque limit for the loosening direction is in a range from about 20% to about 40% greater than that of the maximum torque limit for tightening the oil filter.

In accordance with an aspect of the present disclosure, oil filter socket 5 and oil filter socket 50 each provide embodiments designed to be used with a process for both installing and removing an oil filter 11 from an engine with the torque limiting clutch mechanism 6 contained in either socket 5 or socket 50. Each socket 5, 50 of the present disclosure addresses the heretofore need for a simpler device to correctively install an oil filter to an engine with the proper amount of torque such that excessive tightening or a loose fitting oil filter does not occur.

In one exemplary embodiment, oil filter 11 has an outer canister diameter in a range from about 60 mm to about 120 mm. Inner chamber 28 of cup 10 is sized to complementarily receive an oil filter therein thus also having a diameter in a range from about 60 mm to 120 mm. Additionally, chamber 28 may have a depth close to one third that of the outer diameter of cup 10. So, for example, if cup 10 has an outer diameter of 3 inches, then the axially aligned depth of chamber 28 would be about one inch. The depth of chamber 28 is determined by the axial length of the inner surface defining the inner chamber which is purposefully greater than oil filter cap wrenches that have large outer diameters and narrow depths of filter chambers.

In operation, an operator grasps ratchet 102 and releasably attaches drive extension 16 thereto. The terminal end 42 of drive extension 16 is inserted through bore 32 on nut 12 of filter socket 5 such that the squared end nests within square hole 17 formed in cam 13. Alternatively, in the oil filter socket 50 embodiment, drive extension 16 may be inserted through cam 60 into squared hole 17. Ratchet 102 can rotate about central axis 20 in a tightening manner in a clockwise direction.

Prior to the step of tightening socket 5, a user may selectively set the set screws 19 to a desired maximum torque associated with the torque necessary to attach oil filter 11 to an engine block without over tightening the components together. The set screws selectively set at the maximum torque contact ball bearings 18 against cam 13 thereby applying forcible pressure against spring 14.

As ratchet 102 is rotated about central axis 20 in the clockwise direction, a reciprocal force is applied to socket 5 from the threading of oil filter 11 to the engine block. When the reciprocal force of the threading of oil filter 11 overcomes the set maximum force determined by the set screws application of pressure against spring 14, the ball bearings slide over detents on the set screws such that socket 5 gives way and cannot over tighten oil filter 11 to the engine block.

Figure 9:
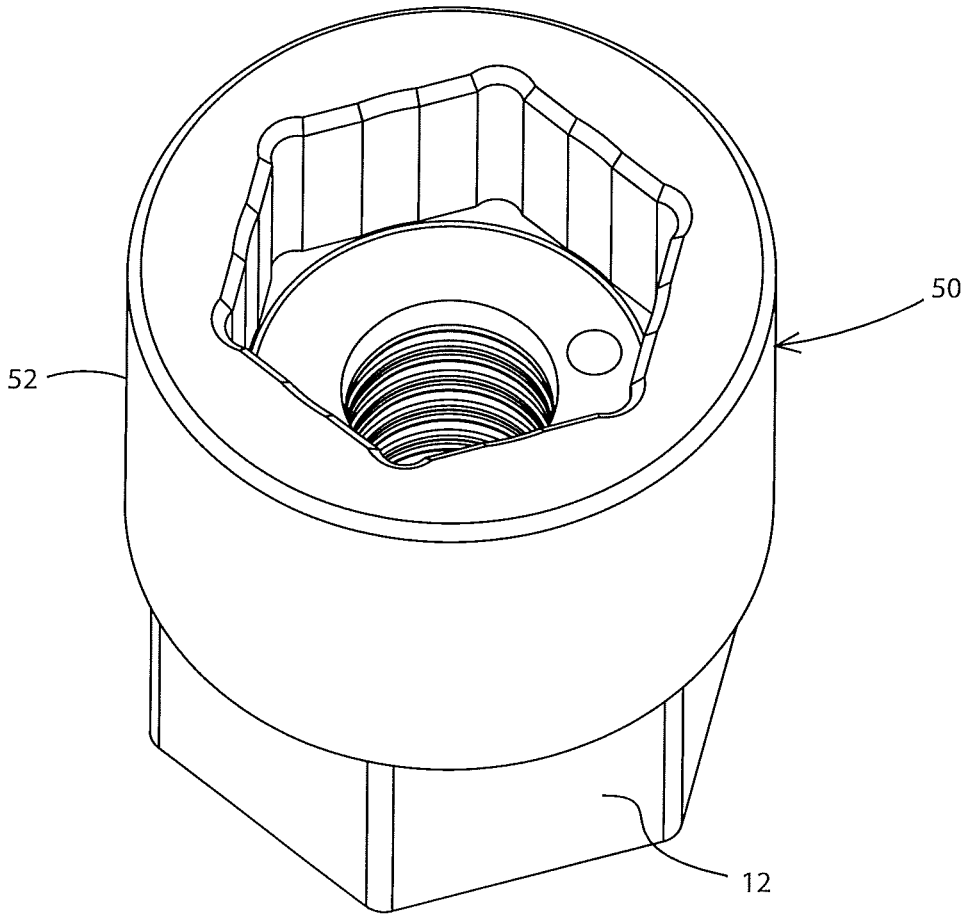
FIG. 9 is a top perspective view of an example of another torque limiting socket device.
Figure 10:
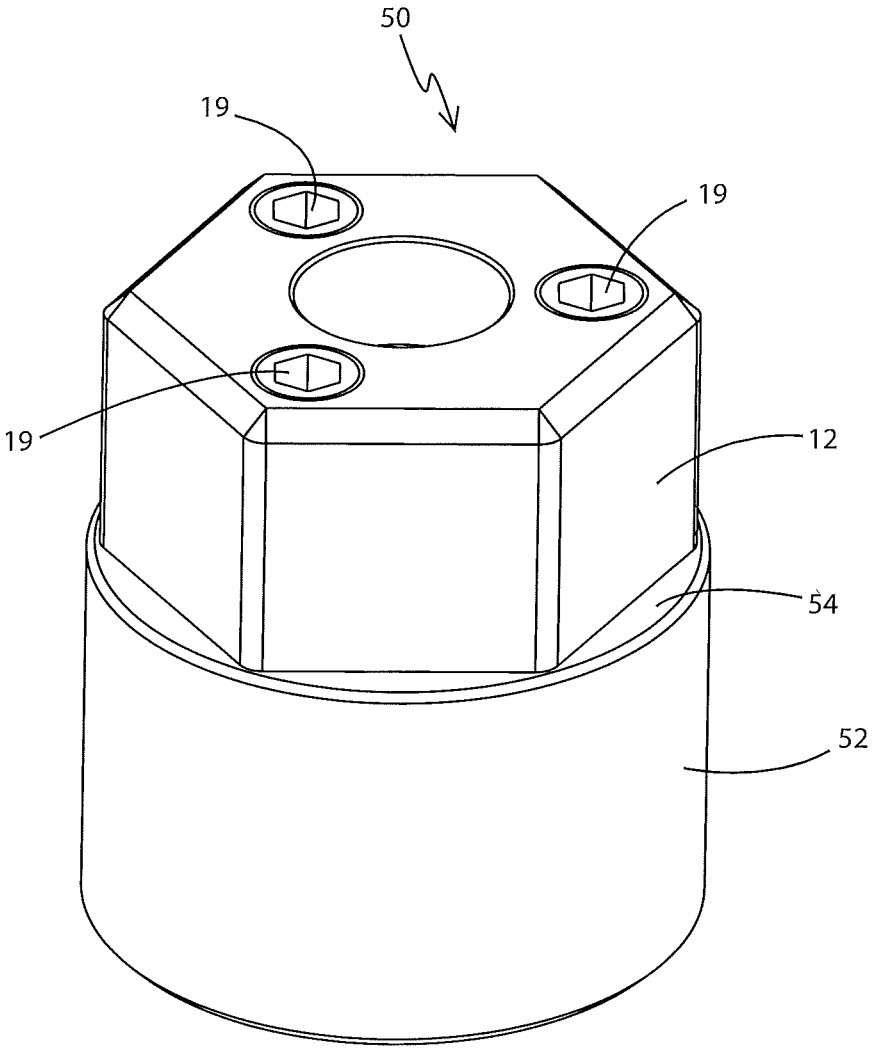
FIG. 10 is a bottom perspective view of the device of FIG. 9.
Figure 11:
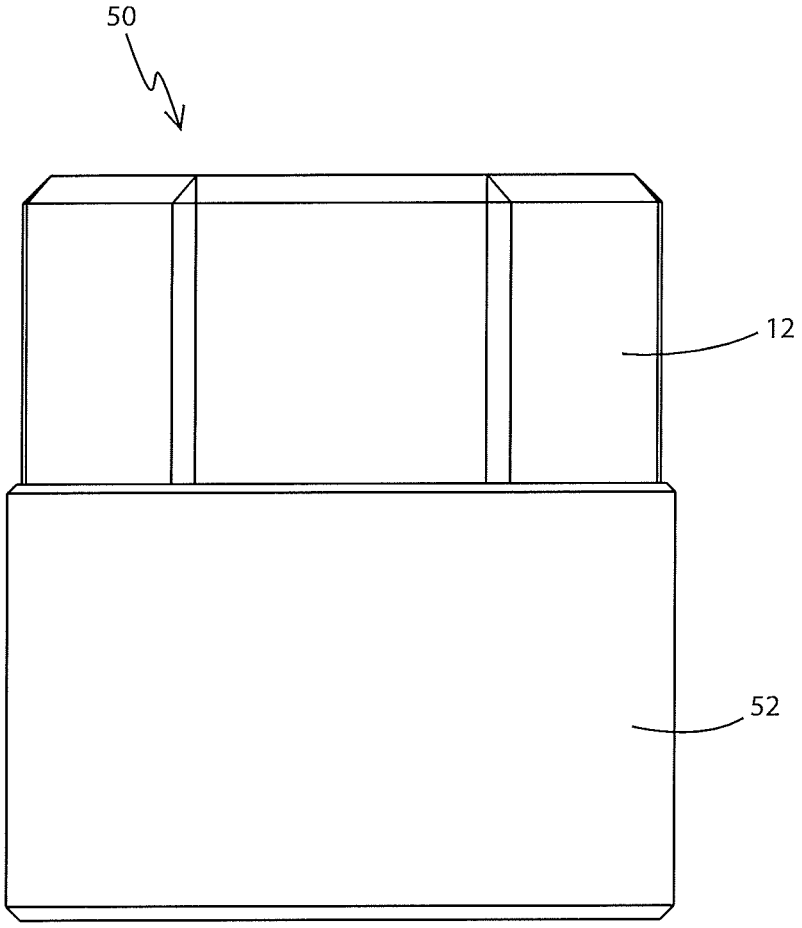
FIG. 11 is a side view of the device of FIG. 9.

The oil filter socket 50 embodiment depicted in FIG. 9 may be releasably attached to a ratchet 102 and the socket portion may be releasably attached to the molded nut on a drop in filter canister attached to a combustion engine.

Figure 17:
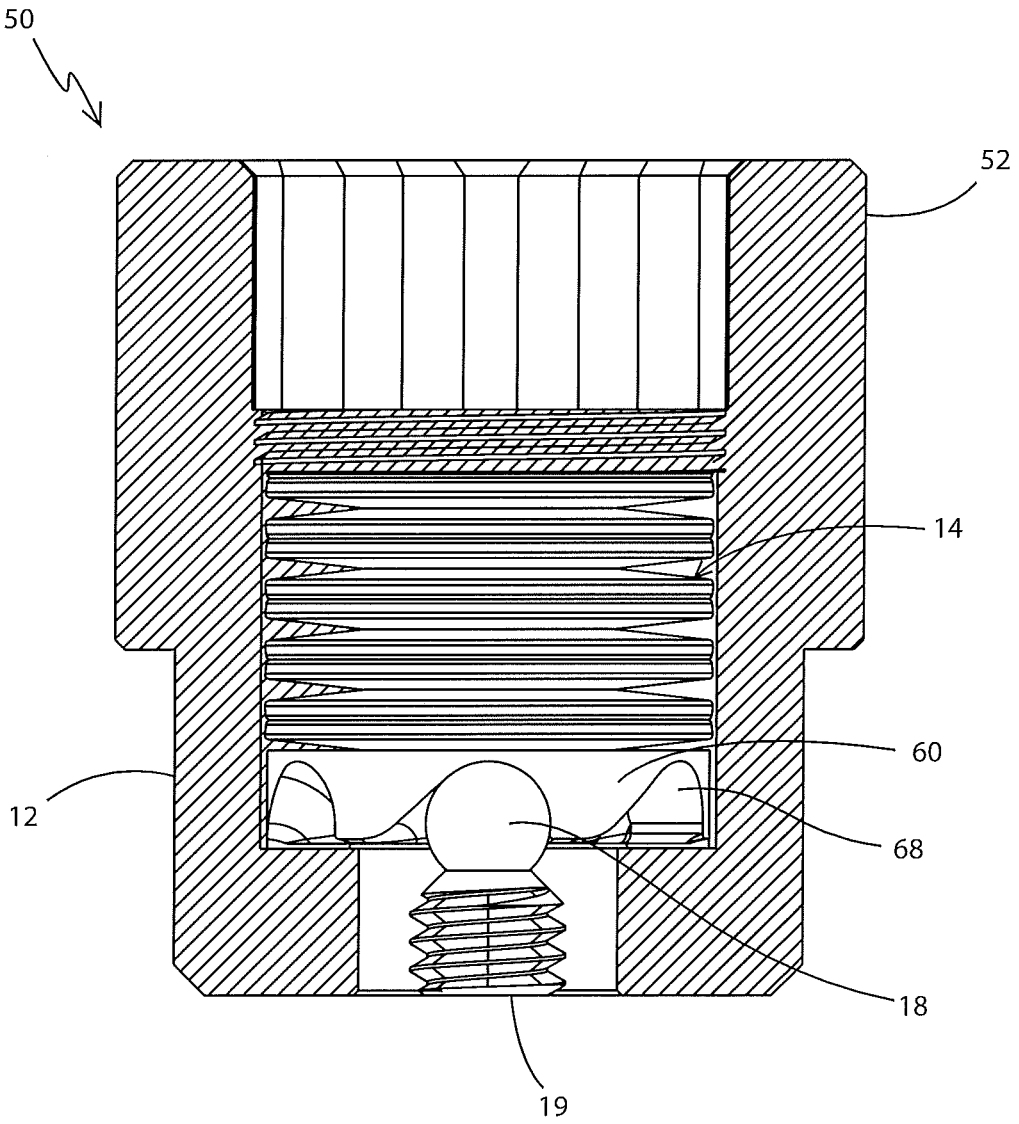
FIG. 17 is a cross section view taken along line XVII-XVII in FIG. 16 with the device in a relaxed, no torque position.
Figure 18:
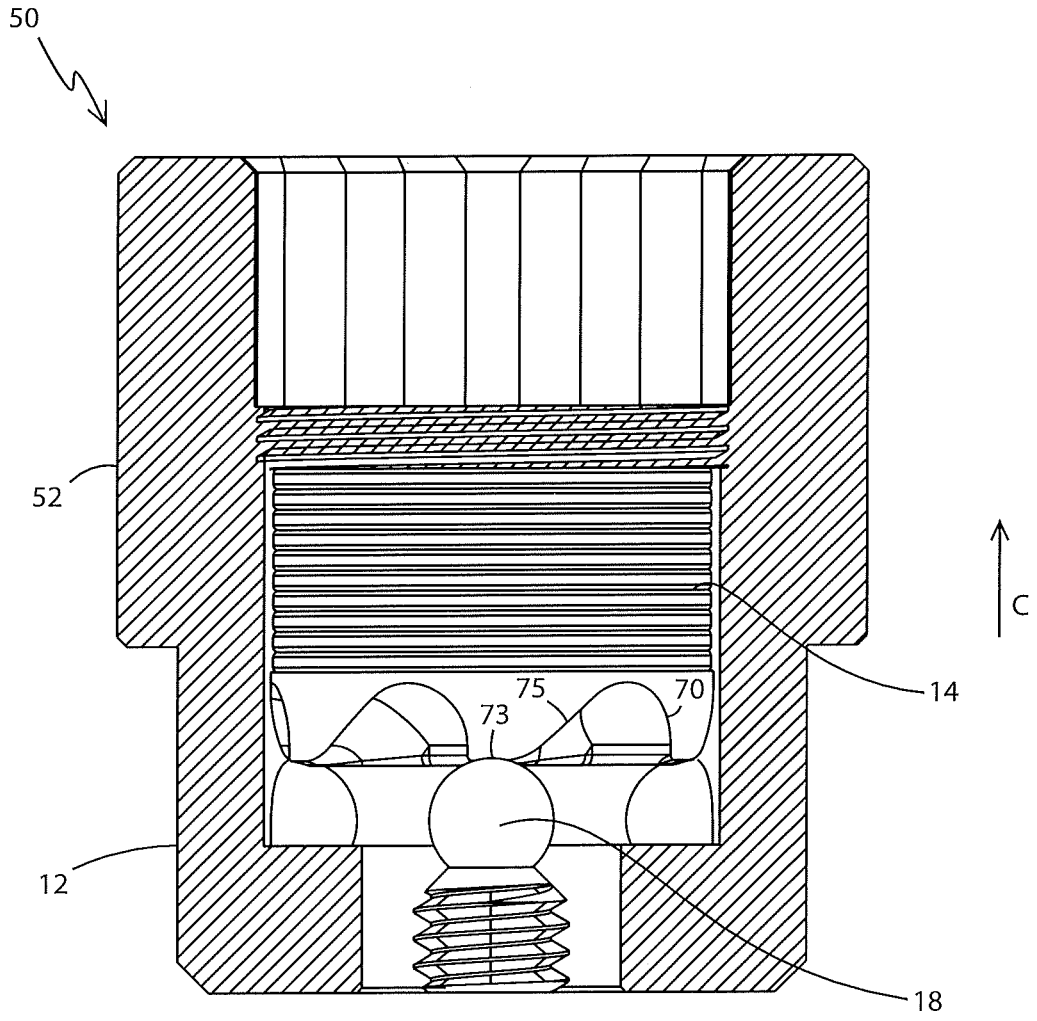
FIG. 18 is a cross section view taken along line XVII-XVII in FIG. 16 with the device with full torque applied.

Prior to the step of attaching socket 50 to the nut on the oil filter canister, an operator selectively sets the screws to a maximum torque limit. Then, as depicted in FIG. 17 and FIG. 18, a user may rotate the socket 50 in either the clockwise or counterclockwise direction. When rotating in the clockwise direction, ball bearing 18 nests within notch 68. When the torque limit exceeds the compression force of spring 14, spring 14 is collapsed in the direction of arrow C thereby allowing the cam to rotate such that ball bearing 18 travels upwardly along first wall 70 towards end 73. In the compressed position of FIG. 18, socket 50 can no longer apply rotational tightening force to the oil filter. Cam 60 will continue to rotate until a ball bearing 18 slides down second wall 75 into an adjacent notch 68. When loosening the oil filter, ball bearing 18 will slide along second wall 75 in the counterclockwise direction. The compressed spring 14 will move in the axial direction identified by arrow C.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the disclosure are an example and the disclosure is not limited to the exact details described.

What is claimed:

1. An oil filter socket, comprising:

a first end spaced opposite a second end and a central axis extending therebetween;

a cup including an edge defining an opening adjacent the first end and an inner surface extending axially towards a closed end, the inner surface defining a filter cavity sized to receive an oil filter therein;

a nut adjacent the closed end exterior the cup and centered about the central axis, the nut defining a bore; and a torque limiting mechanism interior the bore centered about the central axis, the torque limiting mechanism configured to selectively set a tightening torque maximum of the oil filter socket, wherein the torque limiting mechanism comprises a plurality of ball bearings spaced equally around the central axis inside the bore, and wherein the torque limiting mechanism comprises an annular cam interior the bore centered about the central axis and contacting the plurality of ball bearings, the annular cam having a circumferential outer edge, and a portion of each of the plurality of ball bearings is radially outward of the circumferential outer edge.

2. The oil filter socket of claim 1, wherein the torque limiting mechanism comprises a plurality of set screws equal to the number of ball bearings and respectively coupled thereto, and each of the set screws is threadedly adjustable.

3. The oil filter socket of claim 1, wherein the annular cam comprises a cam end facing the first end, and an uppermost portion of each ball bearing facing the first end is closer to the first end than the cam end.

4. The oil filter socket of claim 3, wherein the annular cam defines a bearing race at the cam end, the bearing race having a first incident angle associated with retaining the ball bearings during counterclockwise rotation about the central axis, and having a second incident angle associated with retaining the ball bearings during clockwise rotation.

5. The oil filter socket of claim 4, wherein the first and second incident angles are not equal.

6. The oil filter socket of claim 5, wherein the annular cam comprises a plurality of circumferentially extending notches, each of the notches receiving a respective one of the plurality of ball bearings, each of the notches formed of a first sidewall that slopes up to a top at a first end at the first incident angle, and a second sidewall that extends upwardly towards an upper terminal end at the second incident angle, the first incident angle being smaller than the second incident angle.

7. The oil filter socket of claim 6, wherein a center of each of the plurality of ball bearings is positioned axially inside the annular cam.

8. The oil filter socket of claim 7, wherein there are three ball bearings.

9. The oil filter socket of claim 8, wherein the torque limiting mechanism comprises:

an annular adjustment disc adjacent the second end threadedly received interior the bore and centered about the central axis; and an annular spring interior the bore and centered about the central axis axially intermediate the three ball bearings and the annular adjustment disc.

10. A method, comprising:

providing the oil filter socket of claim 1;

setting a torque maximum limit with the torque limiting mechanism;

connecting the oil filter socket to one of an oil filter canister and an oil filter bolt head; and rotating the oil filter socket with a ratchet until the torque maximum limit has been reached.

11. A torque limiting socket device, comprising:

a first end spaced opposite a second end and a central axis extending therebetween;

a socket adjacent the first end;

a nut adjacent the second end centered about the central axis, the nut defining a bore;

a plurality of ball bearings disposed within the bore and spaced about the central axis;

a spring operatively connected to the plurality of ball bearings; and an annular cam interior the bore centered about the central axis intermediate the plurality of ball bearings and the spring, the annular cam comprising a plurality of circumferentially extending notches, each of the notches formed of a first sidewall that slopes up to a top at a first end at a first incident angle, and a second sidewall that extends upwardly towards an upper terminal end at a second incident angle, wherein each of the notches receives a respective one of the plurality of ball bearings, wherein the first incident angle is associated with retaining the ball bearings during counterclockwise rotation about the central axis, wherein the second incident angle is associated with retaining the ball bearings during clockwise rotation, wherein the first incident angle is smaller than the second incident angle, and wherein the annular cam comprises a circumferential outer edge, and a portion of each of the plurality of ball bearings is radially outward of the circumferential outer edge.

12. The torque limiting socket device of claim 11, wherein a center of each of the plurality of ball bearings is positioned axially inside the annular cam.

13. The torque limiting socket device of claim 12, wherein the annular cam comprises a cam end facing the first end, and an uppermost portion of each ball bearing facing the first end is closer to the first end than the cam end.

14. The torque limiting socket device of claim 13, comprising a plurality of set screws equal to the number of ball bearings and respectively coupled thereto, and each of the set screws is threadedly adjustable.

15. The torque limiting socket device of claim 14, wherein there are three ball bearings.

16. The torque limiting socket device of claim 15, comprising:

an annular adjustment disc adjacent the second end threadedly received interior the bore and centered about the central axis; and an annular spring interior the bore and centered about the central axis axially intermediate the three ball bearings and the annular adjustment disc.

* * * * *